US009677816B2

(12) United States Patent
Pirard et al.

(10) Patent No.: US 9,677,816 B2
(45) Date of Patent: Jun. 13, 2017

(54) GRID PLATE

(75) Inventors: Regnier Pirard, Ougree (BE); Christophe Vielvoye, Fleron (BE)

(73) Assignee: Magotteaux International S.A, Vaux-sous-Chèvremont (BE)

( * ) Notice: Subject to any disclaimer, the term of this patent is extended or adjusted under 35 U.S.C. 154(b) by 617 days.

(21) Appl. No.: 13/700,900

(22) PCT Filed: May 6, 2011

(86) PCT No.: PCT/EP2011/057320
§ 371 (c)(1),
(2), (4) Date: Feb. 6, 2013

(87) PCT Pub. No.: WO2011/151130
PCT Pub. Date: Dec. 8, 2011

(65) Prior Publication Data

US 2013/0130188 A1 May 23, 2013

(30) Foreign Application Priority Data

Jun. 3, 2010 (BE) ..... 2010/0339

(51) Int. Cl.
*F23H 11/10* (2006.01)
*F27D 15/02* (2006.01)

(52) U.S. Cl.
CPC ..... *F27D 15/022* (2013.01)

(58) Field of Classification Search
CPC ..... F27D 15/022; F27D 15/0213; F27D 2015/0233; F23H 17/00; C10J 3/34; C10J 2200/152
USPC ..... 432/77, 78; 110/268, 270, 285, 288, 291
See application file for complete search history.

(56) References Cited

U.S. PATENT DOCUMENTS

| | | | | |
|---|---|---|---|---|
| 4,600,098 | A | 7/1986 | Orren | |
| 4,600,380 | A * | 7/1986 | von Wedel | 432/58 |
| 4,870,913 | A * | 10/1989 | Schneider | 110/299 |
| 5,282,741 | A | 2/1994 | Massaro et al. | |
| 5,575,642 | A | 11/1996 | Willis et al. | |
| 5,947,719 | A * | 9/1999 | Heinemann et al. | 432/78 |
| 5,992,334 | A * | 11/1999 | von Wedel | 110/300 |

(Continued)

FOREIGN PATENT DOCUMENTS

| | | | |
|---|---|---|---|
| CN | 2365218 | Y | 2/2000 |
| DE | 19537904 | A1 | 1/1997 |

(Continued)

*Primary Examiner* — Gregory A Wilson
(74) *Attorney, Agent, or Firm* — Reinhart Boerner Van Deuren P.C.

(57) ABSTRACT

A grid plate for the transporting and cooling of very hot materials leaving a furnace is provided. The plate includes cavities of rectangular shape, the largest dimension being perpendicular to the direction of advance of the materials. The cross section of these cavities being triangular with a fin-shaped bottom terminating in a turned-up end of reverse slope, the slope (α) of the cavities being between 10° and 45°, preferably between 20° and 30°, to the horizontal and the reverse slope (β) of the turned-up end making an angle equal to or up to 6° less than the angle of the slope of the cavities. The flow of material under gravity through the air injection slits is interrupted. Any contact of the material with the framework and with the mechanism of the equipment is avoided.

10 Claims, 2 Drawing Sheets

(56) References Cited

U.S. PATENT DOCUMENTS

| | | | | |
|---|---|---|---|---|
| 6,290,493 | B1 * | 9/2001 | Pirard et al. | 432/77 |
| 8,132,520 | B2 * | 3/2012 | von Wedel | 110/281 |
| 2004/0185408 | A1 * | 9/2004 | Staak et al. | 432/77 |

FOREIGN PATENT DOCUMENTS

| | | | |
|---|---|---|---|
| DE | 10117225 | A1 | 10/2002 |
| EP | 0120227 | A1 | 10/1984 |
| EP | 1060356 | A1 | 12/2000 |
| JP | 09-188551 | | 7/1997 |
| WO | WO 9944001 | A1 | 9/1999 |

* cited by examiner

GRID PLATE

SUBJECT OF THE INVENTION

The present invention relates to a constituent element of a grate cooler, and more particularly to a grate plate intended to convey and cool efficiently and economically a bulk material leaving a furnace at a high temperature.

STATE OF THE ART

The grate cooler is an equipment well known for example for cooling cement clinker after firing. The main functions of this equipment cover cooling, heating recovery and clinker conveying. The cooler generally comprises a bed of superimposed grates lying at an angle to the horizontal.

Document EP0120227 (Orren) explains the basics of the cooling technology using a system of oscillating grates which move the material forward. However, this document does not provide for any system to combat the excessive wear of the plates and does not disclose any construction detail allowing to ensure an efficient cooling of the plates to limit their wear. The design disclosed in this document solely provides for a certain number of inlets that should allow the injection of air.

Document U.S. Pat. No. 4,600,380 (von Wedel) describes a grate plate in the form of a box pierced with very thin slits through which the cooling air is injected. This document proposes to inject the air at a precise angle and provides for giving a curved profile to the slits so that the material to be cooled is unable to flow through the slits, which may possibly clog them, in the case of unexpected interruption of the injection of cooling air. The inlet of these slits is narrowed over the entire length of the slit, which causes a major pressure loss. Moreover, no retaining pocket is provided for and the hot material is in direct contact with the entire surface of the box, which generally leads to early wear.

Document U.S. Pat. No. 5,282,741 (Massaro) discloses a grate plate comprising pockets in the part subjected to the flow of material to be cooled. The flat-bottomed pockets also comprise lateral slits for carrying out an air injection, but the orientation of the pockets is parallel to the flow of material, which does not allow to efficiently influence the flow rate.

Document U.S. Pat. No. 5,575,642 (Willis) proposes a grate plate provided with several pockets which are flat-bottomed, the cooling air being injected through the lateral faces of the pockets. Since it is necessary to provide for channels to bring the air to these injection inlets, the surface subjected to the contact with the hot material to be cooled remains substantial.

Document EP1060356 (Pirard) discloses a grate plate comprising pockets of a particular shape having a inclined bottom and channels for the passage of the cooling air in a particular configuration. These pockets do not have a triangular cross section and have a rim at the point where they are joined to the surface of the grate. The grate plate disclosed by this document does not have any turned-up end having a reverse slope relative to that of the pocket either.

Document DE 195 37 904 A1 discloses a grate plate without pockets. The presence of pockets is however necessary for cooling the grate since the material trapped in the pockets, and already cooled, protects the grate against overheating. The angles precised in this document concern the channels for the injection of cooling gas on the surface of the grate. These angles do not relate to any turned-up end having a reverse slope.

AIMS OF THE INVENTION

The grate plate according to the present invention sets out to overcome the disadvantages of the grate plates of the prior art. The invention is more particularly aimed at a grate plate of a particularly efficient design, allowing a regular moving speed of the bed of material associated with an efficient cooling by means of an efficient injection of cooling air into the system supporting the bed of material, thereby allowing a control over the inevitable wear of these supports.

SUMMARY OF THE INVENTION

The present invention discloses a grate plate for conveying and cooling very hot materials leaving a furnace, said plate comprising cavities of rectangular shape, the largest dimension being perpendicular to the conveying direction of the material, the cross section of these cavities being triangular with a fin-shaped bottom ending in a turned-up end with a reverse slope, the slope of the cavities being comprised between 10 and 45°, preferably between 20 and 30° relative to the horizontal, and the reverse slope ($\beta$) of the turned-up end having an angle equal to or up to 6° less than the angle ($\alpha$) of the slope of the cavities According to particular embodiments of the invention, the latter comprises at least one or a suitable combination of the following characteristics:

- the bottom of each cavity has one or more cooling air injection slits which open into the lowest part of each of the cavities, these slits being oriented so as to inject the air parallel to the bottom of the cavities, these slits being obtained by means of an excess thickness of material arranged on the lower surface of the constituent elements of the grate plate so as to locally narrow the space located between two successive fins;
- the turned-up end of the fin has a length of at least 20 mm;
- the grate plate also comprises, on the front face, one or more air injection slits;
- the slits of the front face of the grate plate have the same length as the slits opening into the bottom of the cavities;
- the slits of the front face of the grate plate are arranged at a distance comprised between 5 and 40 millimeters from the plane of the upper surface of the grate plate.

The present invention also discloses a grate cooler comprising a grate plate according to any one of the preceding characteristics.

KEY TO FIGURES

Figure 1:
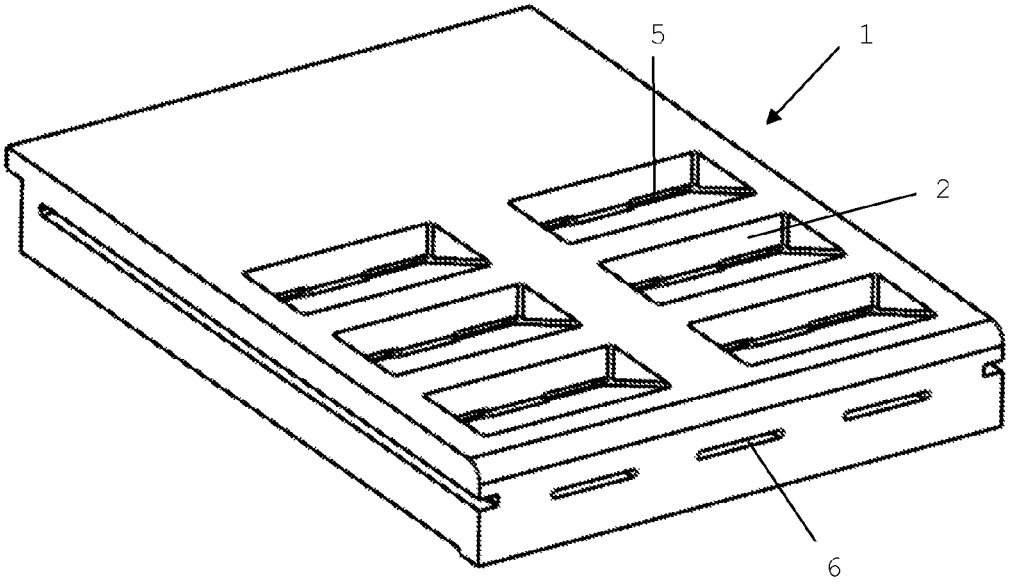
FIG. 1 is a three-dimensional view of the grate plate according to the invention.
Figure 2:
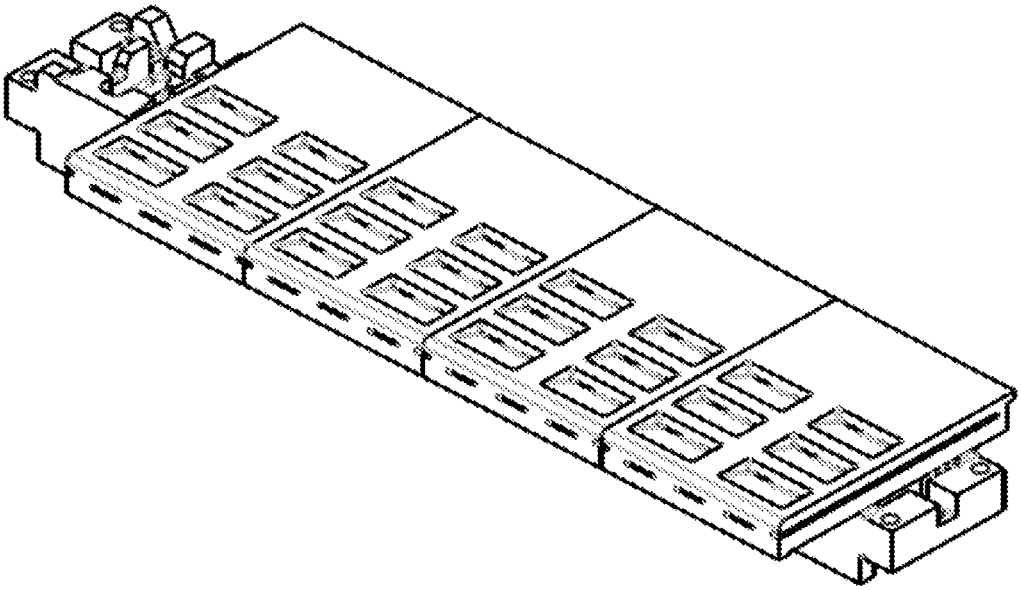
FIG. 2 shows an assembly of grate plates of a conveying line.
Figure 3:
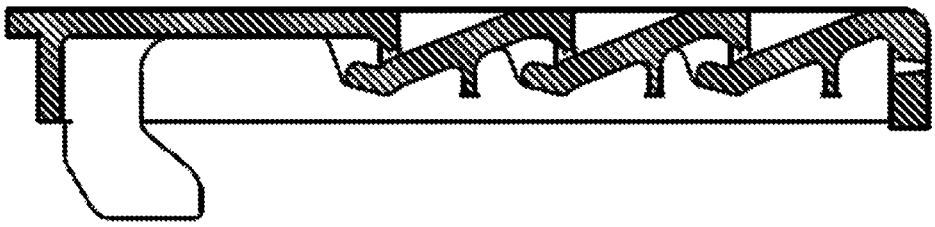
FIG. 3 is a cross-sectional view of the grate plate according to the invention.
Figure 4:
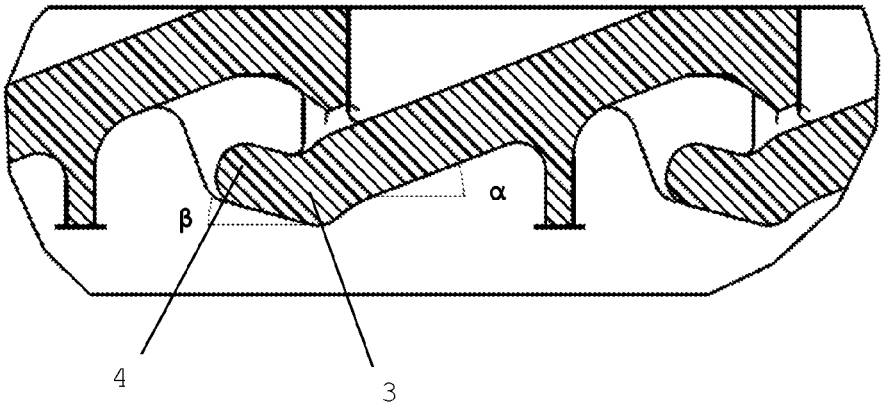
FIG. 4 is a detailed cross-sectional view of the grate plate according to the invention with the alpha and beta angles.
Figure 5:
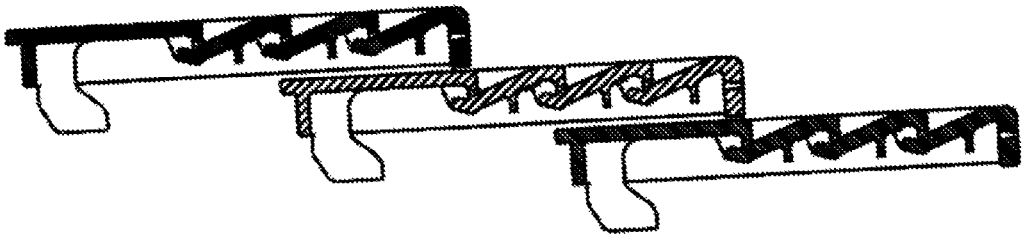
FIG. 5 is a cross-sectional view of several grate plates arranged on a conveying line of a grate cooler.

1. Grate plate
2. Cavity

3. Fin
4. Turned-up end
5. Slits for injecting cooling air into the cavity
6. Slits for injecting cooling air onto the front face of the grate plate.

DETAILED DESCRIPTION OF THE INVENTION

The present invention concerns a constituent element of a cooling system intended to cool efficiently and economically a bulk material being initially at a high temperature, generally higher than 1000° C. Such a cooling system provides for a moving bed of very hot material at a regular rate on aerated grate plates whilst blowing cold air intended to cool this material.

The parameters which must be strictly controlled are the following:

moving speed of the bed of material to be cooled;
cooling efficiency;
regularity of the cooling air injection;
cooling of the system supporting the bed of material;
control over the wear of the elements;
better protection of the under-frame and mechanism of the system against possible attacks coming from the material to be cooled.

The researched construction and the design of these supporting elements, called grate plates, are of prime importance.

In the present invention, it is proposed to control in a particularly efficient manner the moving bed of material to be cooled through the use of several pockets or cavities (2) whose fin-shaped bottom (3) is inclined according to a rising slope in the conveying direction of the material to be cooled, the cross section of the cavity (2) being globally triangular-shaped, which means that each cavity has an intersection along a straight line with the plane of the grate and hence a gentle transition in the conveying direction of the material. There is no rim, no rib, bar or any other obstacle tending to slow down the conveying of the material. This design allows an efficient and regular conveying of the material to be cooled.

The choice of the number of cavities and of the slope angle of the bottom of the pockets is determined by the desired flow rate.

The cooling air is injected through the space comprised between two successive fins in the bottom of the cavities, this space being locally narrowed just before opening into the bottom of each cavity by means of an excess thickness of material solely concentrated on the lower surface of the upper fin and so that the air is injected via one or more slits. This cross section reduction is carried out on a very limited portion of the passageway so as to reduce the pressure loss. When it opens into the cavity, the passageway has the appearance of a slit of 2 to 10 millimeters in width and of 20 to 280 millimeters in length.

In use, for various reasons, the supply of cooling air may be suddenly accidentally interrupted. The material to be cooled located on the grate and filling the cavities must then be prevented from flowing by gravity through the air injection slits, which would have the effect of either filling the lower part of the grate and would compromise the re-starting of the air injection, or of coming into contact with the under-frame and mechanism of the equipment, which would have the effect of damaging them. To this end, the lower end of each fin forming the bottom of a cavity is inclined so that it forms with the horizontal an angle $\beta$ that is equal or up to maximum 6° less than the angle $\alpha$ of the bottom of the cavity but with a reverse slope, i.e. descending in the conveying direction of the material to be cooled. This portion with reverse slope must be of a sufficient minimum length in order to efficiently interrupt the possible flow of material through the air injection passageway. This length is generally greater than 15 mm, preferably greater than 20 mm.

With the aim of limiting the wear rate of the grates, not only must the material be cooled, but the grates themselves must be cooled when in use. To this end, it is provided for that the air be injected into the bottom of the cavities of the grate, by respecting a sufficient flow rate and speed, but also according to a flow, the direction of which is parallel to the bottom of the cavities so that the constituent wall of the bottom of the cavity is efficiently swept by the air and cooled.

The lifetime of the grate plate is determined by the fact that, beyond a certain wear translating into a reduction in the thickness of the constituent elements and walls of the grate subjected to phenomena of oxidation and abrasion due to the passage of the material to be cooled, the grate does not properly fulfil its function and must be dismounted, which requires the complete stoppage of the installation, which is extremely penalising since it implies to give the complete installation the time to cool sufficiently to allow servicing. To reach this objective, the phenomenon of abrasion must be combatted by strictly limiting the surfaces of the grate plate which are directly exposed to the hot material, and the phenomenon of oxidation must be combatted by ensuring that these surfaces are efficiently cooled.

The invention claimed is:

1. A grate plate for conveying and cooling very hot materials leaving a furnace, said grate plate comprising cavities of rectangular shape, the largest dimension being perpendicular to the conveying direction of the material, the cross section of these cavities being triangular with a fin-shaped bottom ending in a turned-up end with a reverse slope, the slope ($\alpha$) of the cavities being comprised between 10 and 45° to the horizontal, and the reverse slope ($\beta$) of the turned-up end having an angle equal to or up to 6° less than the angle ($\alpha$) of the slope of the cavities, the grate plate having in the bottom of each cavity one or more cooling air injection slits opening into the lowest part of each of the cavities, these slits being oriented so as to inject the air parallel to the bottom of the cavities, these slits being obtained by means of an excess thickness of material arranged on the lower surface of the constituent elements of the grate plate so as to locally narrow the space located between two successive fins.

2. The grate plate according to claim 1, characterized in that the turned-up end of the fin has a length of at least 20 mm.

3. The grate plate according to claim 1, characterized in that the grate plate also comprises, on the front face, one or more air injection slits.

4. The grate plate according to claim 3, characterized in that the slits of the front face of the grate plate have the same length as the slits opening into the bottom of the cavities.

5. The grate plate according to claim 3, characterized in that the slits of the front face of the grate plate are arranged at a distance comprised between 5 and 40 millimeters from the plane of the upper surface of the grate plate.

6. A grate cooler comprising a grate plate according to claim 1.

7. The grate plate according to claim 1, wherein the slope (a) of the cavities being comprised between 20 and 30° to the horizontal.

8. The grate plate according to claim 1, wherein each cavity has an intersection along a straight line with the plane of the grate.

9. The grate plate according to claim 1, wherein each cavity has bottom surface defining a straight line, the straight line intersecting with the plane of the grate without curvature.

10. A grate plate for conveying and cooling very hot materials leaving a furnace, said plate comprising a plurality of cavities of rectangular shape, the largest dimension being perpendicular to the conveying direction of the material, wherein the cross section of each cavity of the plurality of cavities is triangular and includes a bottom surface defining a straight line, the straight line intersecting with the plane of the grate without curvature, and wherein each cavity of the plurality of cavities further includes a fin-shaped bottom ending in a turned-up end with a reverse slope, the slope ($\alpha$) of each cavity of the plurality of cavities being comprised between 10 and 45° to the horizontal, and the reverse slope ($\beta$) of the turned-up end having an angle equal to or up to 6° less than the angle ($\alpha$) of the slope of the cavities.

* * * * *